US008070420B2

(12) United States Patent
Chen

(10) Patent No.: US 8,070,420 B2
(45) Date of Patent: Dec. 6, 2011

(54) AIRFLOW-COOLING APPARATUS FOR A CEILING AIR-CONDITIONING CIRCULATION MACHINE

(76) Inventor: Yung-Hua Chen, Sinjhuang (TW)

( * ) Notice: Subject to any disclaimer, the term of this patent is extended or adjusted under 35 U.S.C. 154(b) by 386 days.

(21) Appl. No.: 12/453,941

(22) Filed: May 28, 2009

(65) Prior Publication Data

US 2010/0300128 A1 Dec. 2, 2010

(51) Int. Cl.

| | |
|---|---|
| ***F03D 11/00*** | (2006.01) |
| ***F03D 1/04*** | (2006.01) |
| ***F03D 3/04*** | (2006.01) |
| ***F01D 1/02*** | (2006.01) |
| ***F01D 9/00*** | (2006.01) |
| ***F03B 1/04*** | (2006.01) |
| ***F03B 3/16*** | (2006.01) |
| ***F04D 29/44*** | (2006.01) |
| ***F04D 29/54*** | (2006.01) |
| ***F25D 23/12*** | (2006.01) |
| ***F25D 17/06*** | (2006.01) |

(52) U.S. Cl. .... 415/98; 415/187; 415/208.2; 415/219.1; 62/263; 62/426

(58) Field of Classification Search ..... 415/98, 415/173.6, 187, 208.2, 219.1; 62/125, 263, 62/426

See application file for complete search history.

(56) References Cited

U.S. PATENT DOCUMENTS

| | | | | |
|---|---|---|---|---|
| 6,736,610 | B2 * | 5/2004 | Cifarelli | 417/366 |
| 2009/0314020 | A1 * | 12/2009 | Yoshioka et al. | 62/238.6 |
| 2010/0269537 | A1 * | 10/2010 | Tadokoro et al. | 62/426 |

* cited by examiner

*Primary Examiner* — David S Blum

(74) *Attorney, Agent, or Firm* — Rosenberg, Klein & Lee

(57) ABSTRACT

An airflow-cooling apparatus of a ceiling air-conditioning circulation machine, and more particularly a structure permitting a smooth flow of the indoor air, wherein the drawn current of air passes through a cooling apparatus and then is guided indoors for reducing the temperature. A base frame includes a base frame having a rectangular positioning frame of the rim thereof. A plurality of radial supports are extended from the periphery of the positioning frame inwards. A circular frame is positioned at the center of the base frame. The rim of the circular frame is attached to the radial supports. A fan base is positioned within the circular hole of the circular frame and supported by a plurality of ribs. A plurality of conic and ring-shaped air outflow/inflow channels are concentrically and outwardly interposed between the circular frame and the positioning frame.

7 Claims, 8 Drawing Sheets

AIRFLOW-COOLING APPARATUS FOR A CEILING AIR-CONDITIONING CIRCULATION MACHINE

BACKGROUND OF THE INVENTION

1. Field of the Invention

The invention relates to an airflow-cooling apparatus of a ceiling air-conditioning circulation machine, and more particularly to an apparatus that permits an optimal flow of the indoor air and a considerable reduction of temperature.

2. Description of the Related Art

When offices or factories are interiorly decorated, the ceiling is often made by light steel frame in a grid shape. Thereafter, the ceiling is placed in the grid frame. This kind of the construction way is simple and has low cost. Thus, it is widely used.

In order to enhance the convection of the indoor air, an air-conditioning circulation machine or a fan is often placed into the grid frame. Such a structure is disclosed in TW M251939, M322475, etc. However, the conventional fan or circulation machine is employed only to draw the indoor air from the bottom thereof and to deliver it by a vane wheel indoors. However, it is pity that the convection air can't be cooled for reducing the indoor temperature. For example, the temperature of the indoor air is 28° C. The conventional fan can be used only for enhancing the flow of the indoor air. The simple inflow/outflow action can't achieve the cooling effect. Therefore, it is not easy to reduce the temperature of the air. The energy consumed by the air-conditioners and the carbon released by these will be considerably reduced when the indoor temperature is reduced by 1 or 2° C. This effect is particularly significant in the current energy-shortage age.

SUMMARY OF THE INVENTION

An object of the invention is to provide an airflow-cooling apparatus of a ceiling air-conditioning circulation machine that permits an optimal convection of the indoor air. During the convection, the drawn air can be cooled for reducing the temperature thereof. In this way, the indoor temperature can be reduced by means of the continuous circulation flow. Thus, the energy consumption and the carbon release can be reduced.

Another object of the invention is to provide an airflow-cooling apparatus of a ceiling air-conditioning circulation machine whose air outflow/inflow channels are concentrically arranged in a conic shape, thereby achieving a 360° thorough inflow effect.

BRIEF DESCRIPTION OF THE DRAWINGS

The accomplishment of this and other objects of the invention will become apparent from the following descriptions and its accompanying figures of which.

DETAILED DESCRIPTION OF THE PREFERRED EMBODIMENT

Figure 1:
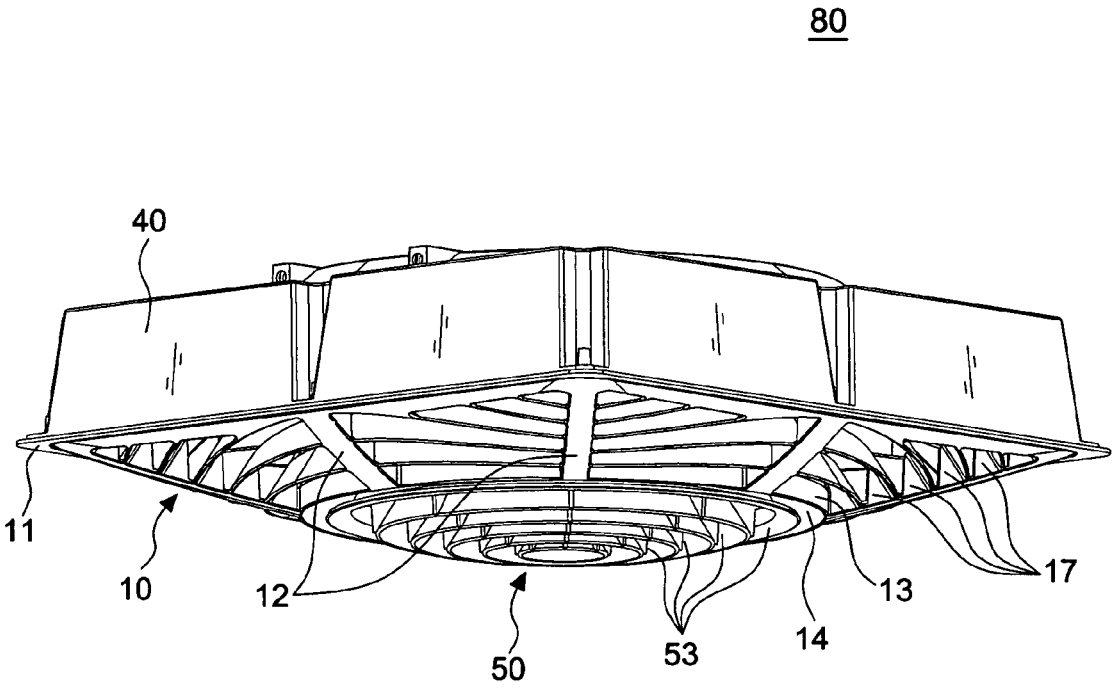
FIG. 1 is a perspective view of the apparatus of the invention seen from bottom to top in a slanting way.

First of all, referring to FIGS. 1 through 8, an airflow-cooling apparatus of a ceiling air-conditioning circulation machine in accordance with the invention includes a base frame 10, a fan 20, a signal-receiving controller 30, and a cover cap 40.

Figure 2:
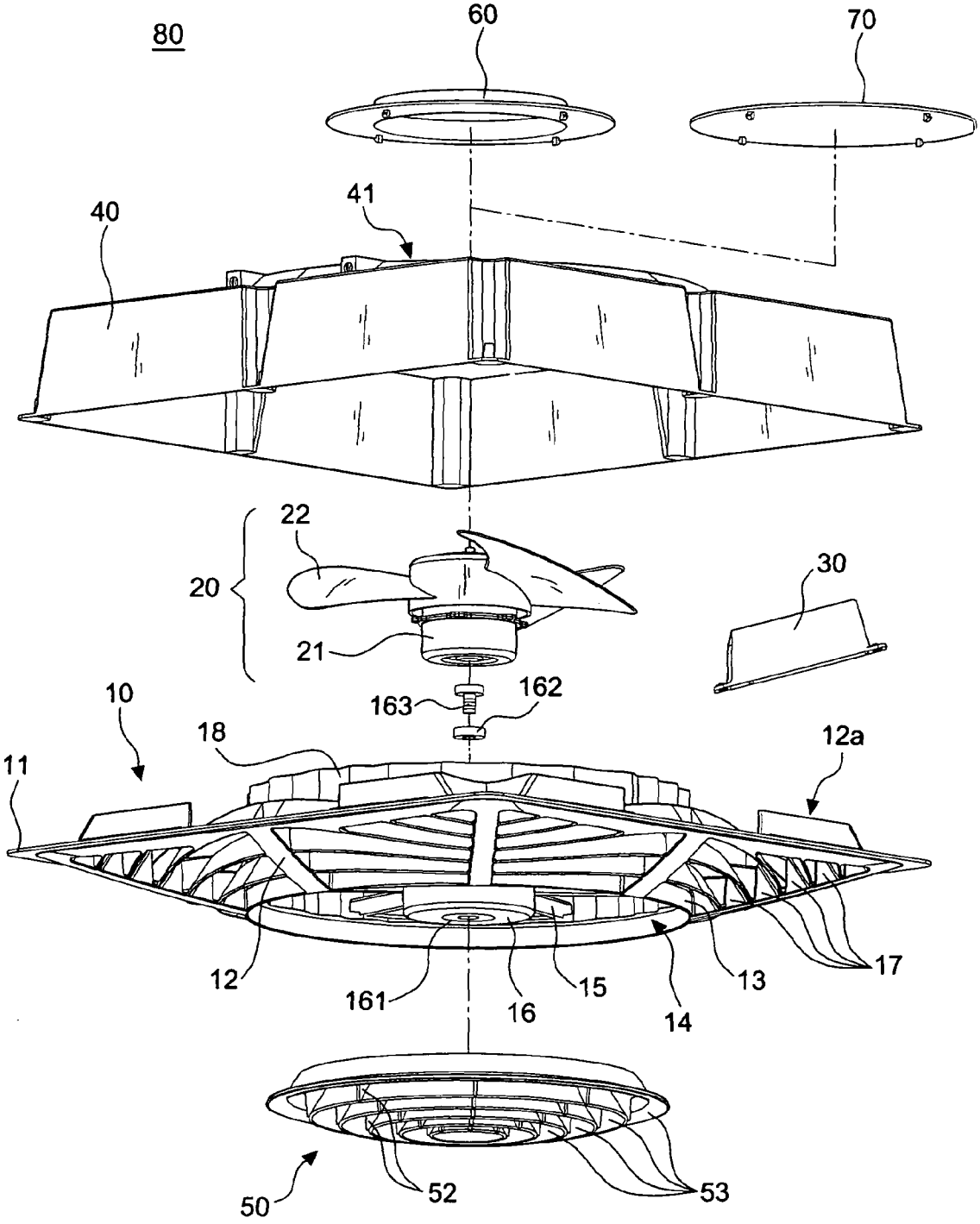
FIG. 2 is an exploded perspective view of the apparatus in accordance with the invention.
Figure 3:
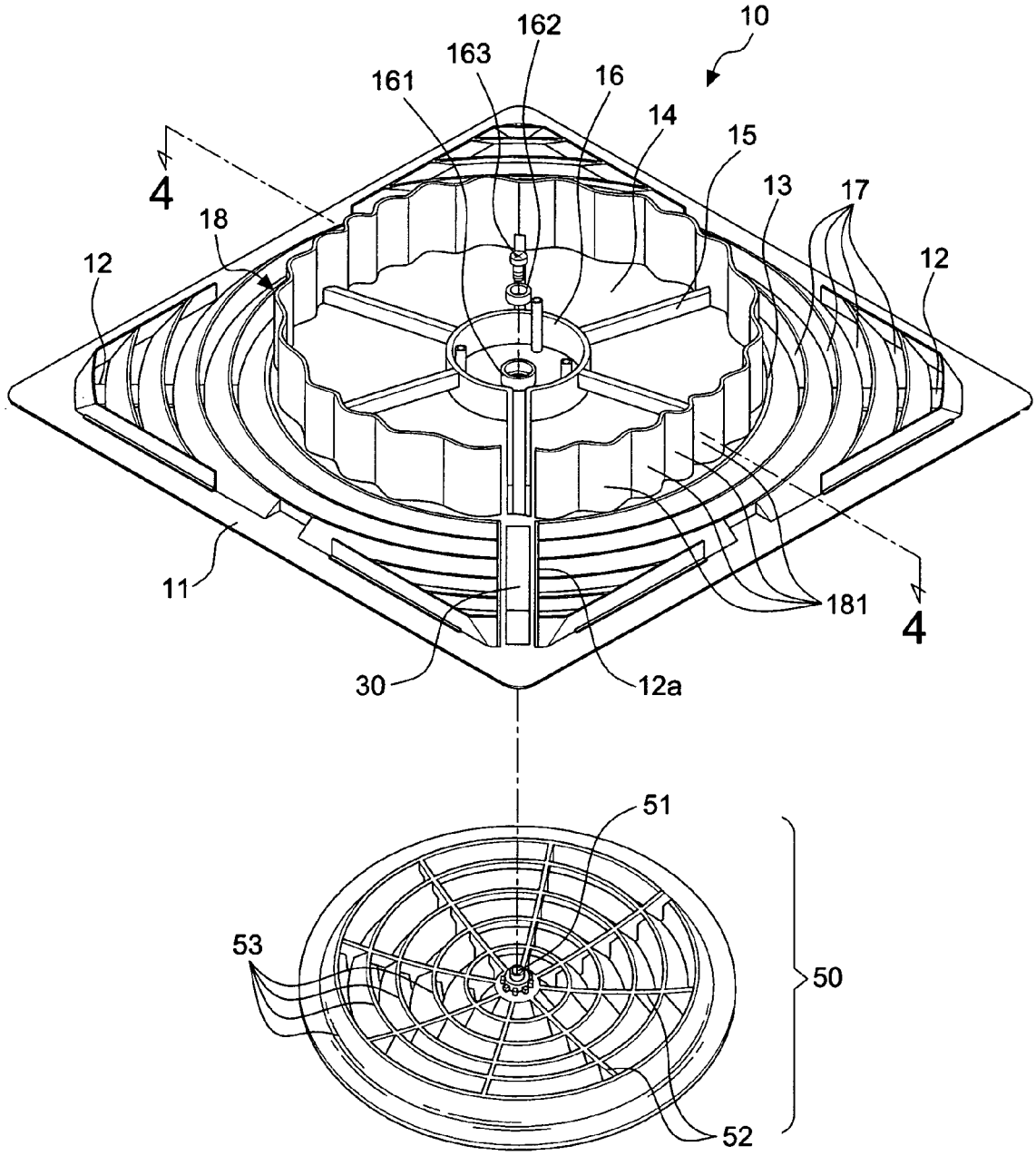
FIG. 3 is a perspective view of the base frame and the diversion disc in accordance with the invention.
Figure 4:
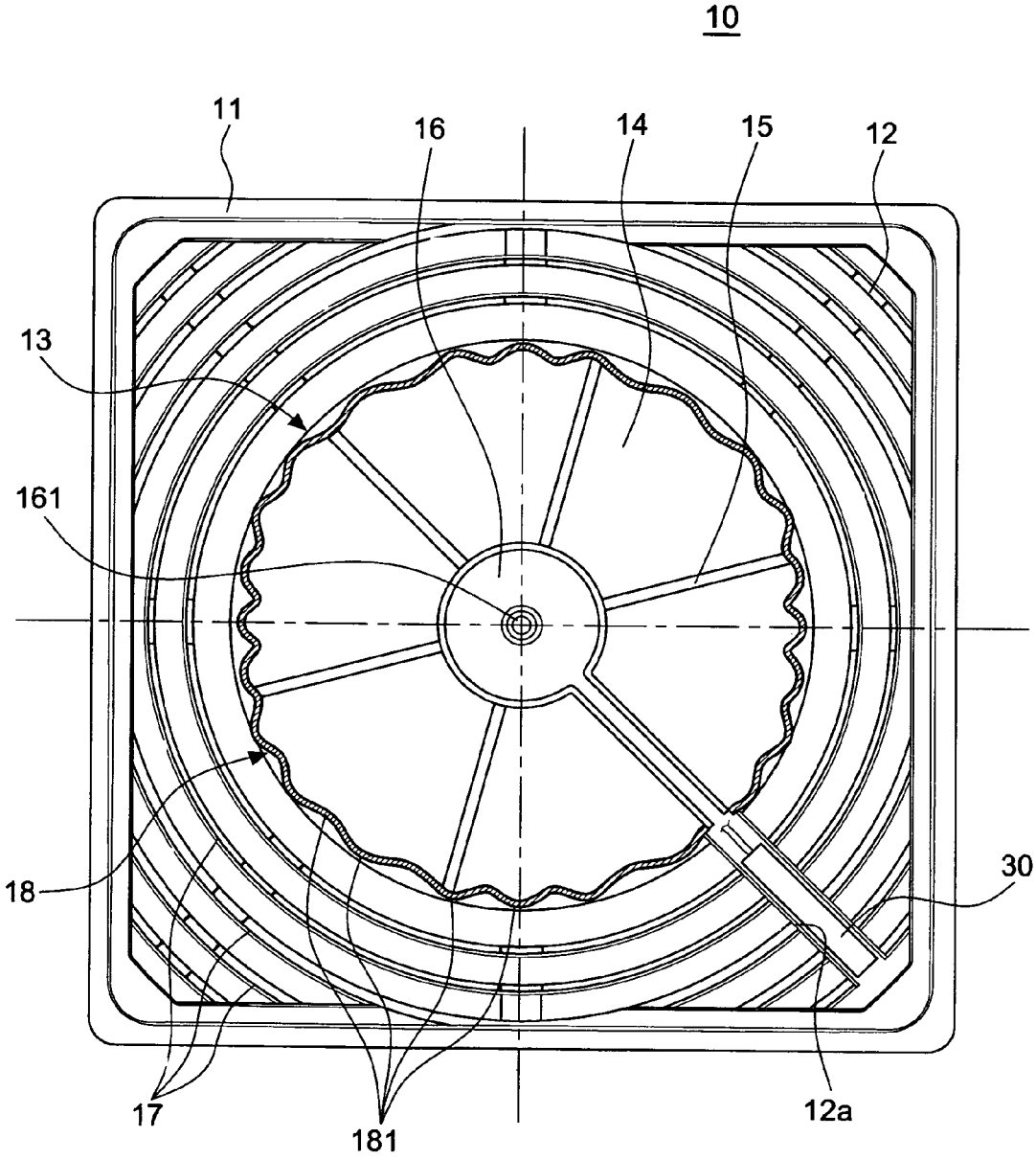
FIG. 4 is a top view of the apparatus in accordance with the invention.

As shown in FIG. 3, the base frame 10 includes a rectangular positioning frame 11 at the rim thereof for installing within a grid frame (not shown) of a light steel frame. A plurality of radial supports 12 are extended from the periphery of the positioning frame 11 inwards (see FIGS. 1 and 2). A circular frame 13 is positioned at the center of the base frame 10. The rim of the circular frame 13 is attached to the radial supports 12. In other words, the circular frame 13 is supported and fixed by the radial supports 12. Moreover, a fan base 16 is positioned within the circular hole 14 of the circular frame 13 and supported by a plurality of ribs 15. A plurality of conic and ring-shaped air outflow/inflow channels 17 are concentrically and outwardly interposed between the circular frame 13 and the positioning frame 11. Besides, a wave-shaped cooling ring frame 18 is disposed on the circular frame 13. According the embodiment shown in FIGS. 3 and 4, the wave-shaped structure consists of differently sized waves 181. The waves 181 are sized according to the distance of that from the positioning frame 11. For example, the distance from four sides of the positioning frame 11 is smaller, and there are only three rings in the area of the air outflow/inflow channels 17 there. Therefore, small waves may be used in this case. However, large waves should be used when the distance from four edges of the positioning frame 11 is greater, and there are many air outflow/inflow channels 17. Still, the waves should be sized according to the outflow/inflow amount for meeting the actual requirements.

Figure 6:
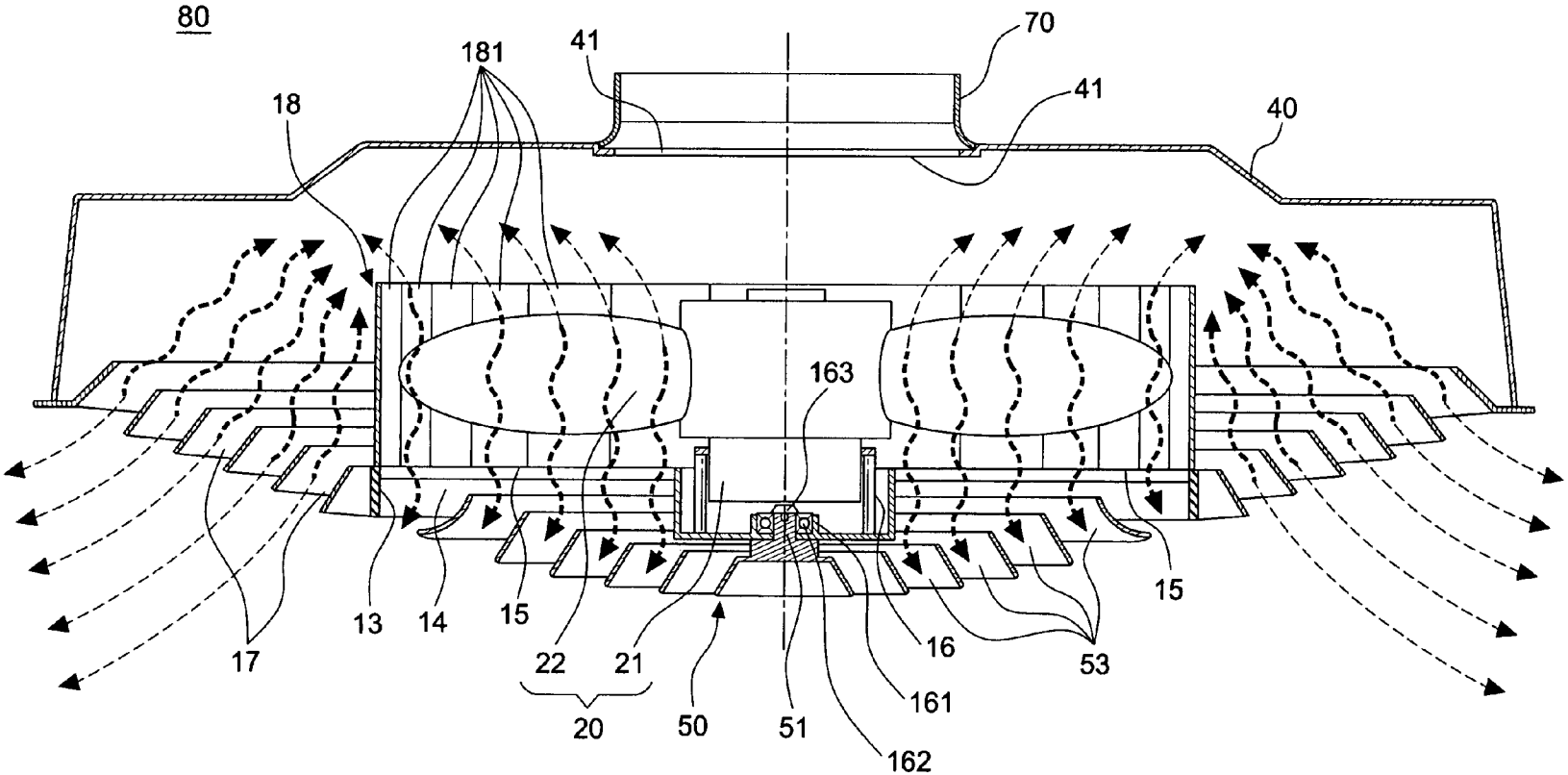
FIG. 6 is a cross-sectional view taken along the line 6-6 in FIG. 5.

As shown in FIG. 2, the fan 20 consists of a motor 21 and a vane wheel 22. The motor 21 is installed on the fan base 16, as shown in FIG. 3 with the vane wheel 22 directed upwards, as shown in FIG. 6.

The signal-receiving controller 30 is positioned on the base frame 10 and electrically coupled with the fan 20. According to the embodiment, as shown in FIG. 3, a receiving groove **12*a* is formed in one of the radial supports 12 of the base frame 10 for accommodating the signal-receiving controller 30. The signal-receiving controller 30 is adapted to receive the hard-wire or wireless control signal from the operator for controlling the on/off state of the fan 20**. The control circuit thereof belongs to the prior art so that no further descriptions thereto are given hereinafter.

The cover cap 40 is placed upon the rectangular positioning frame 11 of the base frame 10. Based on the assembly of the above-mentioned components, an air-conditioning circulation machine 80 is created.

Furthermore, a bearing block 161 is provided at the center of the bottom surface of the fan base 16 for receiving a bearing 162. Moreover, a diversion disc 50 is accommodated within the circular hole 14 of the circular frame 13. As shown in FIG. 3, a connection shaft 51 facing to the bearing block 161 is provided at the center of the diversion disc 50 for fitting downward into the bearing block 161 and attaching to the bearing 162. As shown in FIG. 6, a positioning element 163 is attached to the top of the connection shaft 51 for fixing the bearing 162 in place without detachment. At that time, the diversion disc 50 is freely rotatable under the fan 20. In addition, the diversion disc 50 includes a plurality of radial separation pieces 52. A plurality of conic and ring-shaped diversion pieces 53 are concentrically and outwardly positioned around the connection shaft 51. As shown in FIG. 6, the conic and ring-shaped diversion pieces 53 are arranged in such a manner that they have a downward protruding middle part and a staged structure at the rim thereof so as to form a ∪-shape.

Figure 5:
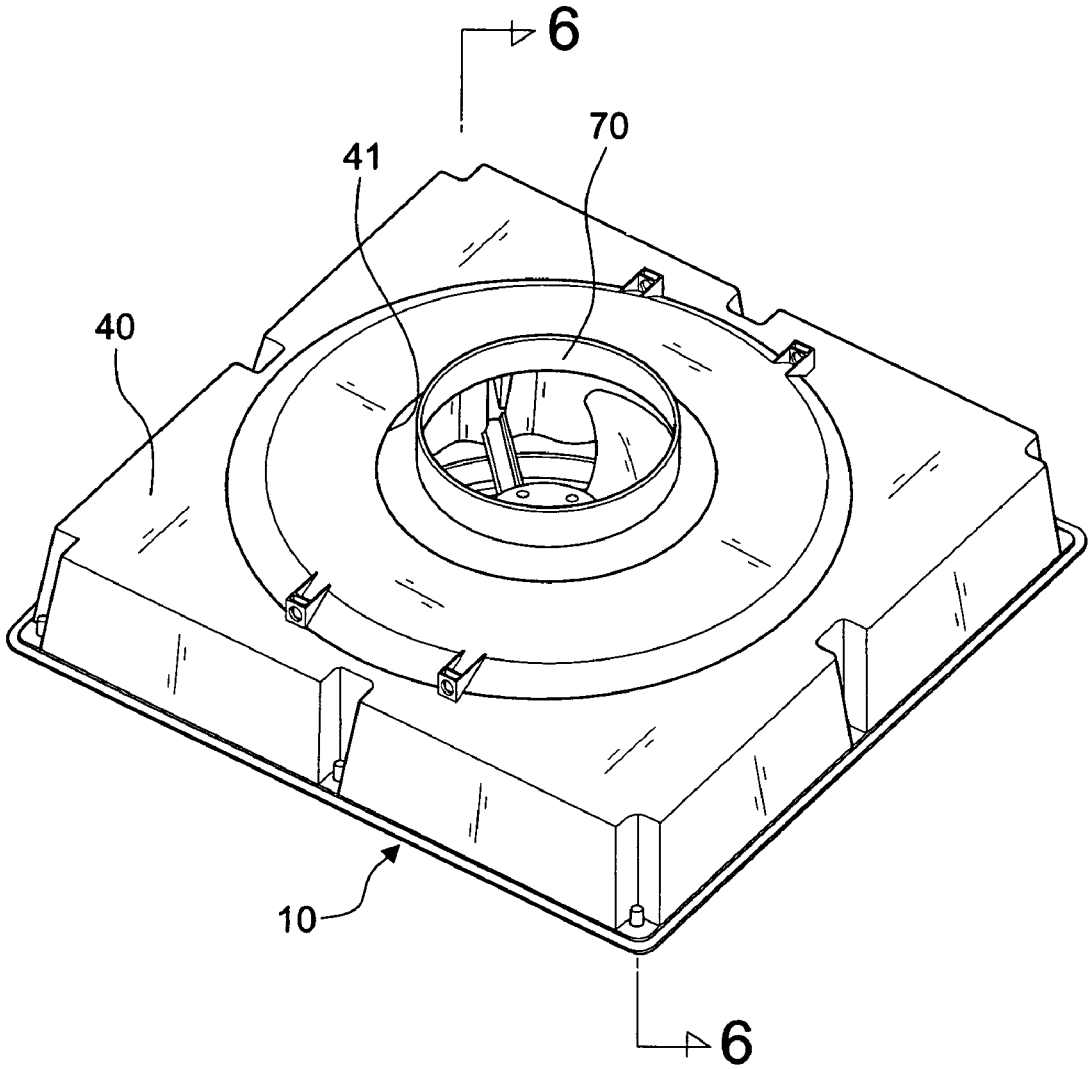
FIG. 5 is a perspective view of an applicable embodiment of the cover cap in accordance with the invention.
Figure 7:
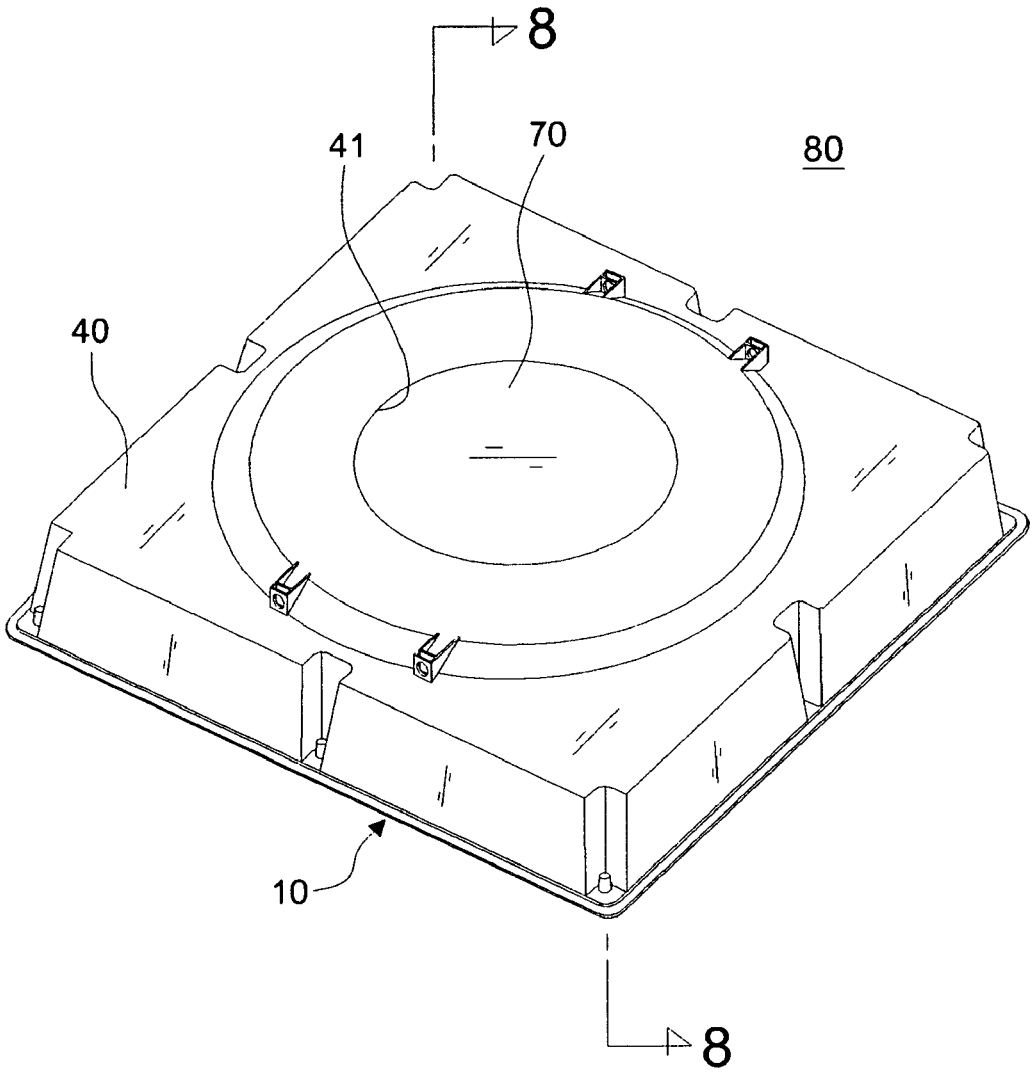
FIG. 7 is a perspective view of another applicable embodiment of the cover cap in accordance with the invention.
Figure 8:
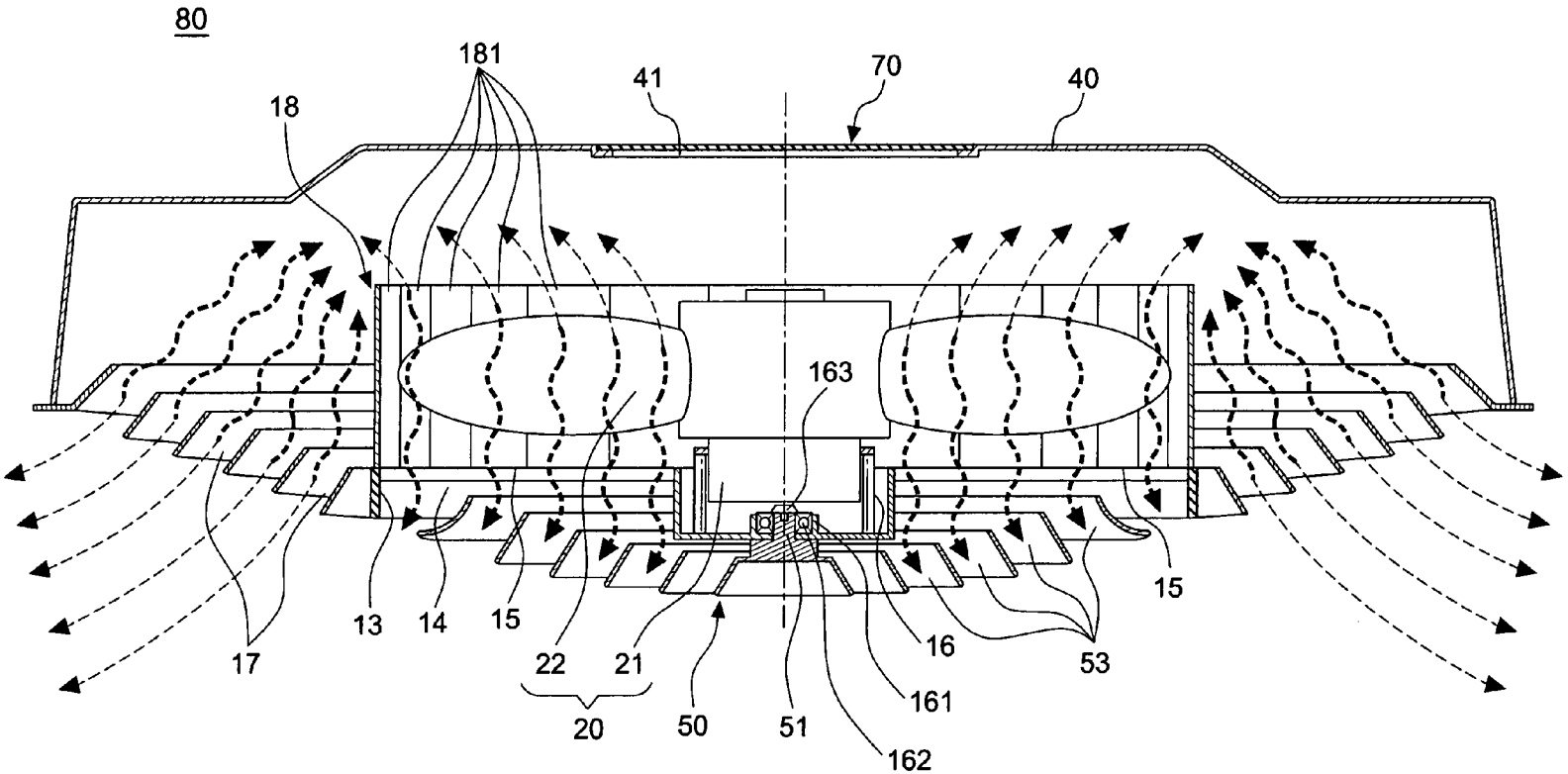
FIG. 8 is a cross-sectional view taken along the line 8-8 in FIG. 7.

As shown in FIGS. 5 and 6, a recessed through hole 41 is provided at the top surface of the cover cap 40. A connecting tube 60 fits into the through hole 41 so as to be in connection with a vent pipe (not shown). As shown in FIGS. 7 and 8, the through hole 41 is covered by a cover plate 70 in a closed state. The cover plate 70 and the connecting tube 60 may be applied to the air-conditioning circulation machine 80 in accordance with the actual requirements. This won't be described more hereinafter. In fact, the air within a room can be drawn from the circular hole 14 at the center thereof and delivered via the ring-shaped diversion pieces 53 at the rim thereof outside. Alternatively, the air outside can be drawn through the ring-shaped diversion pieces 53 at the outer rim and delivered via the circular hole 24 at the center thereof outside. The above-mentioned relates just to the adjustment of the inflow/outflow so that no further descriptions thereto are given hereinafter.

Based on the above-mentioned construction, the following advantages can be achieved:

1. Unlike the conventional fan, which is often installed on the cover cap, the fan 20 is installed on the base frame 10. This configuration permits an easy formation of the through hole 41 in the cover cap 40. In this way, the cover plate 70 or the connecting tube 60 is usable, thereby achieving the effect of "one machine for two functions"

2. The internal side of the positioning frame 11 serves as air outflow/inflow channels 17 that are concentrically arranged in the shape of cone and ring. In other words, the positioning frame 11 has a Λ-shaped cross section. In this way, the air under the ceiling may be drawn upward or diffused downward effectively, thereby achieving an optimal inflow/outflow efficiency.

3. The air drawn into the air-conditioning circulation machine 80 will be in contact with the cooling ring frame 18. Due to the wavy structure 181 of the cooling ring frame 18, the air will flow in a wavy way, thereby enhancing the cooling effect. As a result, the temperature may be reduced when the air is delivered by the fan 20 via the diversion disc 50 indoors. Consequently, the structure in accordance with the invention may achieve the convection and heat-dissipation effect. Moreover, the energy consumption and the carbon release can be reduced.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. An airflow-cooling apparatus of a ceiling air-conditioning circulation machine, comprising:

a) a base frame having a rectangular positioning frame at the rim thereof, a plurality of radial supports being extended from the periphery of the positioning frame inwards, a circular frame being positioned at the center of the base frame, the rim of the circular frame being attached to the radial supports, a fan base being positioned within the circular hole of the circular frame and supported by a plurality of ribs, a plurality of conic and ring-shaped air outflow/inflow channels being concentrically and outwardly interposed between the circular frame and the positioning frame, a wave-shaped cooling ring frame 18 being disposed on the circular frame;

b) a fan consisting of a motor and a vane wheel, the motor being installed on the fan base with the vane wheel directed upwards;

c) a signal-receiving controller positioned on the base frame and electrically coupled with the fan; and d) a cover cap placed upon the rectangular positioning frame of the base frame.

2. The airflow-cooling apparatus of a ceiling air-conditioning circulation machine as recited in claim 1 wherein the wave-shaped structure of the cooling ring frame consists of differently sized waves.

3. The airflow-cooling apparatus of a ceiling air-conditioning circulation machine as recited in claim 1 wherein a bearing block is provided at the center of the bottom surface of the fan base for receiving a bearing, and wherein the diversion disc is accommodated within the circular hole of the circular frame, and wherein a connection shaft facing to the bearing block is provided at the center of the diversion disc for fitting downward into the bearing block and attaching to the bearing such that the diversion disc is freely rotatable under the fan, and wherein the diversion disc includes a plurality of radial separation pieces, and wherein a plurality of conic and ring-shaped diversion pieces are concentrically and outwardly positioned around the connection shaft, and wherein the conic and ring-shaped diversion pieces are arranged in such a manner that they have a downward protruding middle part and a staged structure at the rim thereof so as to form a ∪-shape.

4. The airflow-cooling apparatus of a ceiling air-conditioning circulation machine as recited in claim 1 wherein a receiving groove is formed in one of the radial supports of the base frame for accommodating the signal-receiving controller.

5. The airflow-cooling apparatus of a ceiling air-conditioning circulation machine as recited in claim 1 wherein a recessed through hole is provided at the top surface of the cover cap.

6. The airflow-cooling apparatus of a ceiling air-conditioning circulation machine as recited in claim 5 wherein a connecting tube fits into the through hole.

7. The airflow-cooling apparatus of a ceiling air-conditioning circulation machine as recited in claim 5 wherein a cover plate is positioned in the through hole.

* * * * *